United States Patent [19]

Jacobs

[11] Patent Number: 4,480,752

[45] Date of Patent: Nov. 6, 1984

[54] PINCH CLOSURE BAGS WITH OPENING FEATURE AND METHOD OF MANUFACTURING THEM

[75] Inventor: Richard W. Jacobs, Eden Prairie, Minn.

[73] Assignee: Bemis Company, Inc., Minneapolis, Minn.

[21] Appl. No.: 406,213

[22] Filed: Aug. 9, 1982

[51] Int. Cl.[3] ..... B65D 3/26

[52] U.S. Cl. ..... 206/632; 206/633; 383/88; 383/123; 493/212; 493/930; 493/963

[58] Field of Search ..... 206/628, 626, 632, 633, 206/604, 603, 613, 620, 621; 229/55, 57, 62, 62.5, 17 G, 17 R; 383/88, 123; 493/212, 377, 930, 963, 923; 53/412, 133

[56] References Cited

U.S. PATENT DOCUMENTS

| | | | |
|---|---|---|---|
| 1,843,234 | 2/1932 | Karnes et al. | 206/633 X |
| 1,987,596 | 1/1935 | Cox | 206/604 |
| 2,041,375 | 5/1936 | Schmerler | 229/62 |
| 2,072,796 | 3/1937 | Christopher | 206/633 X |
| 2,100,141 | 11/1937 | Jackson | 206/604 |
| 2,121,443 | 6/1938 | Olsson | 206/613 |
| 2,262,111 | 11/1941 | Moore | 229/55 |
| 2,263,821 | 11/1941 | Williams | 206/604 |
| 2,285,189 | 6/1942 | Cornock | 206/633 X |
| 2,475,236 | 7/1949 | Gollub | 229/62 |
| 3,042,285 | 7/1962 | Smith | 206/633 X |
| 3,074,610 | 1/1963 | Pugh | 229/176 |
| 3,193,180 | 7/1965 | Lissner | 229/55 |
| 3,446,420 | 5/1969 | Rinecker | 229/62 |
| 3,565,328 | 2/1971 | Hudson | 229/55 |
| 3,687,356 | 8/1972 | Goodrich et al. | 229/55 |
| 3,776,451 | 12/1973 | Goodrich et al. | 229/55 |
| 3,850,366 | 11/1974 | Saito | 229/55 |
| 4,069,964 | 1/1978 | Willet et al. | 229/62.5 |
| 4,260,061 | 4/1981 | Jacobs | 206/626 |
| 4,441,613 | 4/1984 | Haln et al. | 206/621 |

*Primary Examiner*—Allan N. Shoap
*Assistant Examiner*—Bryon Gehman
*Attorney, Agent, or Firm*—Senniger, Powers, Leavitt and Roedel

[57] ABSTRACT

A paper bag having a pinch closure provided with a tab extending from within the bag between the portions of the walls of the bag in the pinch closure and projecting out of the pinch closure, the projecting portion of the tab being adapted to be grasped and pulled to tear the bag open at the pinch closure, and a method of manufacturing it involving provision of a bag tube, opening up the tube at one end, and inserting the tab in the tube.

20 Claims, 14 Drawing Figures

PINCH CLOSURE BAGS WITH OPENING FEATURE AND METHOD OF MANUFACTURING THEM

BACKGROUND OF THE INVENTION

This invention relates to bags, more particularly to pinch closure bags with an easy-opening feature, and a method of manufacturing them.

The invention relates especially to gusseted multiwall pinch bottom open mouth ("PBOM") bags, and is concerned with providing an easy way to open the filled and sealed bags, being in the same general field as the bags shown in U.S. Pat. Nos. 3,565,328, 3,687,356 (FIGS. 12 and 13) and 3,850,366.

SUMMARY OF THE INVENTION

Among the several objects of the invention may be noted the provision of a bag having a pinch closure, e.g., a so-called pinch bottom bag, with an improved easy-open feature adapted cleanly to open the bag; the provision of a gusseted multiwall pinch bottom open mouth bag with such a feature; the provision of such a bag with a valve for filling the bag; and the provision of a method of manufacturing such bags which lends itself to machine production of the bags with the easy-open feature.

In general, a bag of this invention has a pinch closure at one end and a tab for opening it at said end. The bag is formed from a bag tube having first and second walls, the second wall having an extension beyond the first at said end. The closure comprises a flap constituted by an end portion of the bag tube at said end folded over on a fold line spaced inwardly from the end edge of the first wall at said end, the flap thereby comprising the end portion of the first wall from the fold line to said end edge of the first wall, a portion of the second wall coextensive with said end portion of the first wall and said extension of the second wall. The tab has a section between said portions of the walls, a section underneath said extension, and an outer end section projecting out from under said extension. The flap and the section of the tab underneath the extension are adhered to the outside face of the first wall. The outer end section of the tab is free at least in part of the first wall to enable said outer end section of the tab to be grasped and pulled to tear the bag open.

In general, the method of this invention comprises providing a bag tube having first and second walls with an extension of the second wall beyond the first wall at one end of the tube, opening up the tube at said one end, and inserting a tab into the tube with the tab at its inner end being disposed between the walls and at its outer end extending out beyond the end edge of the extension at said one end, and adhering the tab to said second wall. A pinch closure for the bag tube is formed at said one end by folding over a flap constituted by an end portion of the tube at said one end on a fold line extending transversely of the bag tube spaced inwardly from the respective end edge of said first wall, the tab being folded over with the flap. The flap and the section of the tab underneath the extension are adhered to said first wall, leaving the outer end section of the tab which extends out beyond the end edge of the extension free at least in part of said first wall.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
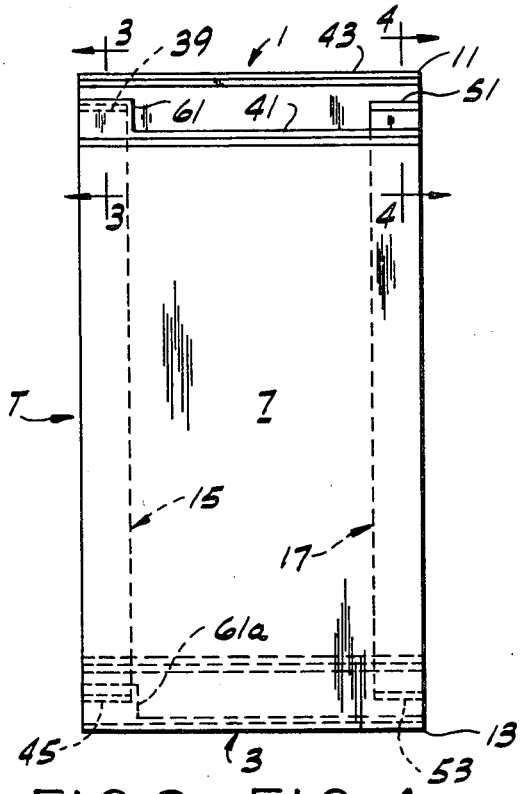
FIG. 1 is a view in elevation of one face of a gusseted multiwall paper bag tube having its ends formed for formation of pinch closures and incorporation in one of the closures (the closure at the top as illustrated) of a tab for easy, clean opening of the bag as ultimately completed and filled.
Figure 2:
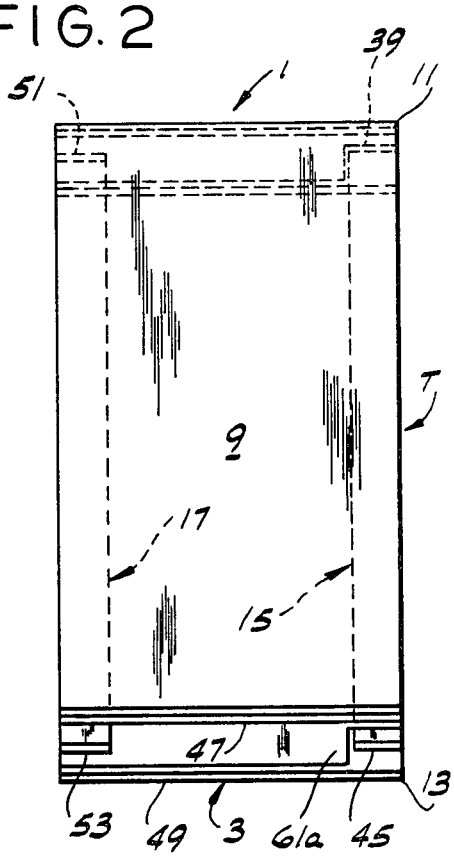
FIG. 2 is a view in elevation of the other face of the FIG. 1 bag tube.
Figure 9:
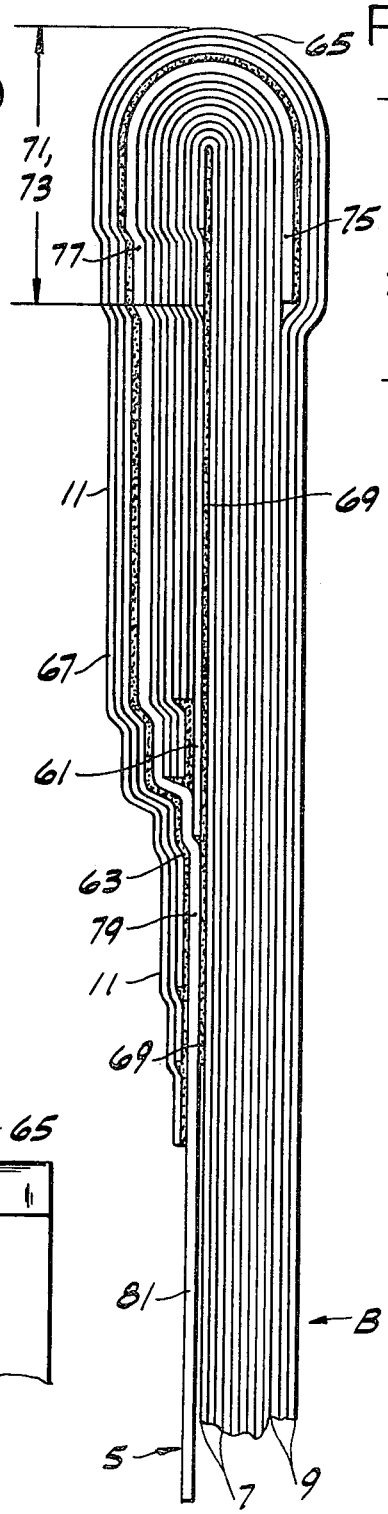
FIGS. 9 and 10 are greatly enlarged sections on lines 9—9 and 10—10 of FIG. 8.
Figure 10:
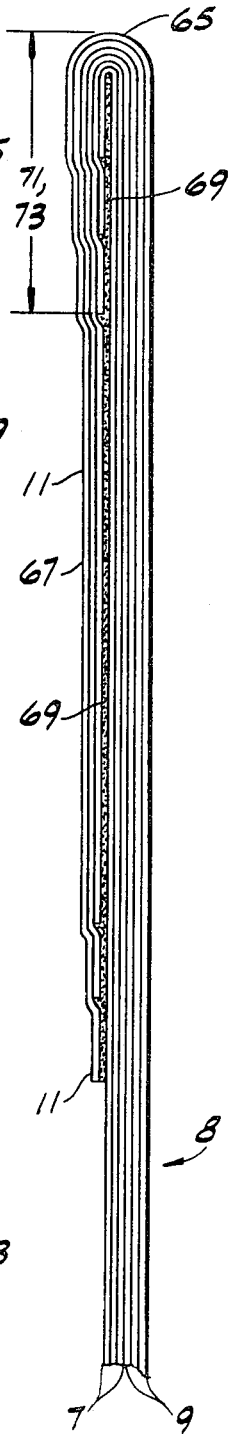
Figure 8:
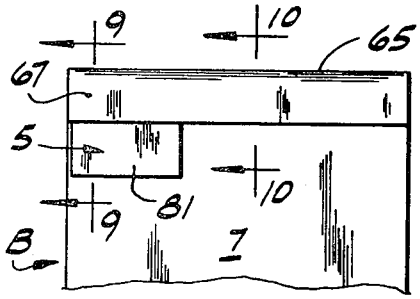
FIG. 8 is a view in elevation similar to FIG. 7 showing the completed pinch closure closing the the upper end of the bag, and also showing the tab.

Referring to the drawings, FIGS. 1-4 illustrate a gusseted bag tube generally designated T having its ends which are indicated at 1 and 3 formed for formation of pinch closures and incorporation in one of the closures (the upper closure, as illustrated) of a tab 5 as shown in FIGS. 5-8 for easy clean opening of the bag as ultimately completed and filled. The bag completed with a pinch closure is shown in FIGS. 8-10, designated B. One wall of the tube T (and the bag B) is designated 7 and the other 9. These are flat against one another. Wall 7 may be referred to as the first or front wall, and wall 9 as the second or back wall. The second or back wall 9 of the bag tube T has an extension 11 at one end (its top end as illustrated in FIG. 1) beyond the respective end edge of the first or front wall 7, the latter having a corresponding extension 13 at the other end (the lower end as illustrated in FIG. 1) beyond the back wall 9.

The gussets of the bag are generally indicated at 15 and 17. Gusset 15 (which is at the left in FIGS. 1 and 6) has what may be termed a first or front half 19 and a second or back half 21, the front half being joined to the front wall 7 at a fold line 23, the two halves 19 and 21 being joined at a fold line 25 (the center fold of the gusset), and the back half being joined to the back wall 9 at a fold line 27. Similarly, gusset 17 (at the right in FIGS. 1 and 6) has what may be termed a front half 29 and a back half 31, the front half being joined to the front wall 7 at a fold line 33, the two halves 29 and 31 being joined at a fold line 35 (the center fold of the gusset), and the back half being joined to the back wall 9 at a fold line 37.

Gusset 15 has an upper end portion generally indicated at 39 extending beyond the upper end edge 41 of wall 7 at the upper end of the bag tube T and terminating short of the upper end edge 43 of extension of the back wall, and a corresponding lower end portion generally indicated at 45 extending beyond the lower end edge 47 of wall 7 at the lower end of the bag tube and terminating short of the lower end edge 49 of extension 13 of the front wall. Similarly, gusset 15 has an upper end portion generally indicated at 51 extending beyond the upper end edge 41 of wall 7 at the upper end of the bag tube and terminating short of the upper end edge 43 of extension 11 of the back wall, and a corresponding lower end portion generally indicated at 53 extending beyond the lower end edge 47 of wall 9 at the lower end of the bag tube and terminating short of the lower end edge 49 of extension 13 of the front wall 7. The front and back halves of both gussets are preferably stepped at their ends as appears in FIGS. 1–6, such stepping of the gusset halves being conventional and well known in the art (see, for example, U.S. Pat. No. 3,687,356).

Figure 3:
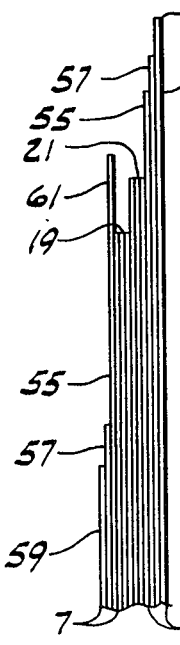
FIGS. 3 and 4 are enlarged sections on lines 3—3 and 4—4, respectively, of FIG. 1, thicknesses being exaggerated.
Figure 4:
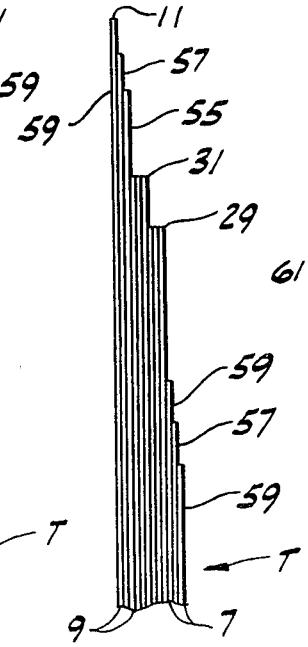

As illustrated, the tube T (and hence bag B) is a multi-wall (i.e., multiple ply) tube, shown as having three plies; an inner ply 55, an intermediate ply 57 and an outer ply 59. Within the scope of the invention, the bag may be a single-ply bag or have various numbers of plies. All the plies may be paper, or the bag may have a plastic ply. The plies preferably are stepped at the upper margin of extension 11 and at the lower margin of extension 13, as appears in FIGS. 1–6, such stepping being generally conventional and well known in the art (see, for example, U.S. Pat. No. 3,687,356). As shown in FIGS. 3, 4 and 6, the plies are not stepped at the ends of the gusset halves, although they could optionally be stepped in a conventional and well known manner (again see U.S. Pat. No. 3,687,356).

Figure 5:
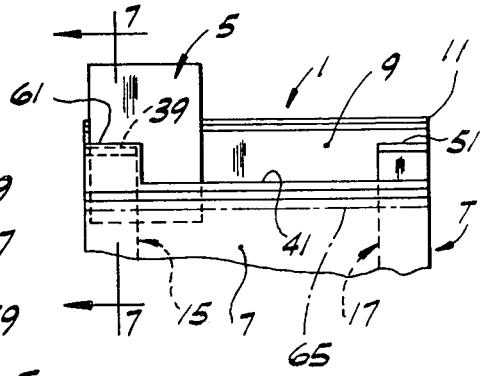
FIG. 5 is a view showing the top of the FIG. 1 bag tube with a tab inserted for provision of the easy-open feature in accordance with this invention.
Figure 6:
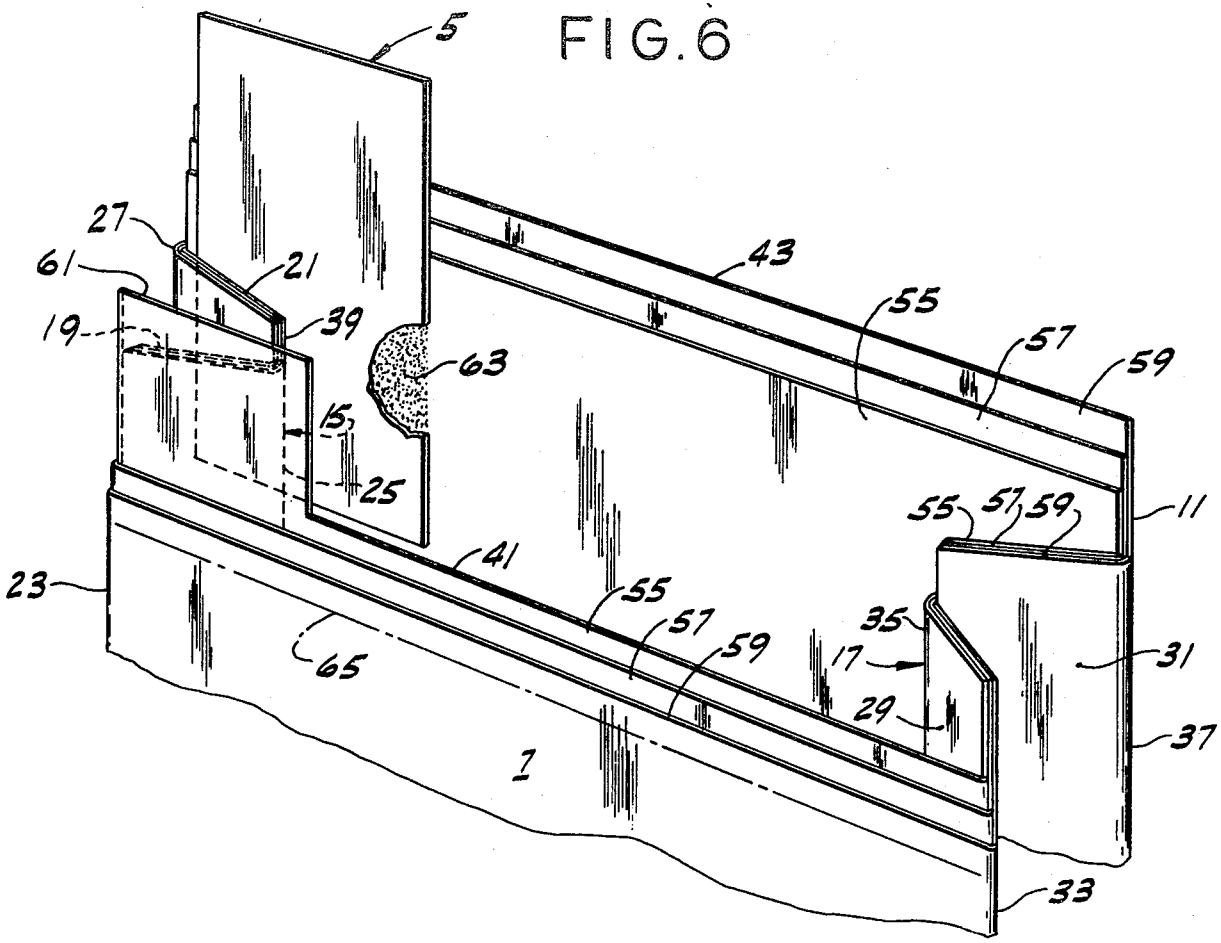
FIG. 6 is a perspective showing the top of the FIG. 1 bag tube opened up (i.e., with the bag walls spread apart) and the tab inserted as in FIG. 5, on a larger scale than FIGS. 1 and 5.
Figure 7:
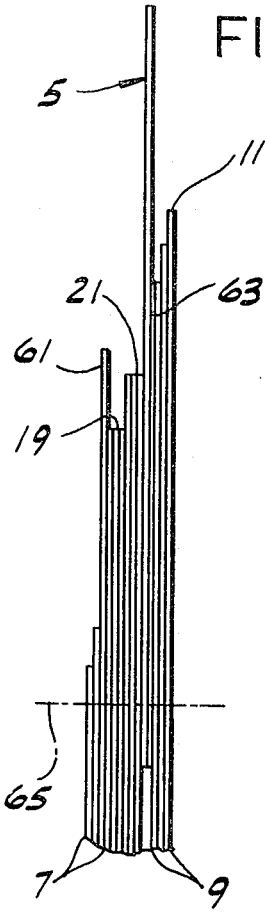
FIG. 7 is a view similar to FIG. 3 taken on line 7—7 of FIG. 5 and showing the tab inserted in the end of the bag tube as in FIGS. 5 and 6.

The stated first or front wall 7 of the bag tube T is specially formed in accordance with this invention with an extension or tongue 61 of the inner ply 55 at the left side and at the upper end (the upper left corner) of the bag tube as viewed in FIGS. 1, 5 and 6 covering the end portion 39 of gusset 15 which projects up above the upper end edge 41 of wall 7 of the bag tube at the upper left corner. This extension or tongue 61 is slightly wider than the width of a gusset half and projects up beyond the upper end of the gusset 15 as a whole, i.e., the tongue projects up above the upper end of the back half 21 of the gusset (which is stepped up above the upper end of the front half 19 of the gusset). As manufactured on a bag tuber with the extension or tongue 61, the tube T has a notch 61*a* at end 3 in the inner ply 55 complementary to the tongue.

As shown in FIGS. 5 and 6, one end (the upper end as illustrated) of the bag tube is opened up, i.e., the walls 7 and 9 are separated, and tab 5, which may comprise a rectangular piece of relatively stiff, strong heavy paper or paperboard, is inserted in the open upper end of the bag tube at the left side of the bag tube as viewed in FIGS. 5 and 6 between the back half 21 of the left-hand gusset 15 and the back wall 9 (including extension 11) of the tube. The tab is of such width as to enable it to be firmly grasped between the thumb and the fingers of the hand for the ultimate pulling of the tab to tear the bag open (as will appear) and of such height that it may extend from within the bag tube up above the upper end edge 43 of the back wall 9 of the bag tube. Typically, the tab is about six inches wide, and its height will vary depending on the size of the bag tube. It is inserted in the open upper end of the bag tube with its left edge at the fold 27 where the back half 21 of the gusset 15 joins the back wall, and is adhesively secured (as by means of hot-melt glue, for example) to the back wall of the bag as indicated at 63. The tab is inserted in the stated open upper end of the bag tube T at least to the point where its inner edge is inward of (below, as illustrated in FIGS. 5 and 6) the upper end edge 41 of the first or front wall 7 of the bag tube. And it is preferably inserted to the point where its inner end edge is somewhat (e.g., ½ inch) inward of (below, as illustrated in FIGS. 5 and 6) the line indicated at 65 on which the upper end edge portion of the bag tube is subsequently folded over to form a pinch closure.

Figure 11:
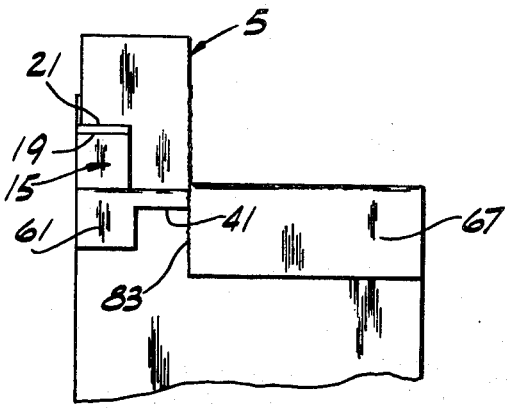
FIG. 11 is a view similar to FIG. 8 showing the tab pulled up to open the bag.

The upper end of the bag tube T, having the tab 5 incorporated therein as above described, is formed with a pinch closure (a "pinch bottom" for the bag) indicated by the reference numeral 67. This closure comprises a flap folded over on fold line 65 which extends transversely across the bag tube spaced inwardly from (i.e., below as shown in FIGS. 5 and 6) the upper end edge 41 of the first or front wall 7, the flap being folded to overlie the wall 7 and being adhered to by adhesive, such as a hot melt glue, as indicated at 69 to the wall 7. With the fold line 65 spaced inwardly from the end edge 41 of the wall 7, the closure or flap 67 comprises a portion 71 of the wall 7, a portion 73 of the other wall 9 coextensive with portion 7, and the extension 11 of wall 9. The tab 5 is folded on line 65 along with the flap 67 and, in the completed pinch closure, has a section 75 inward of (below) the fold line 65 between the walls 7 and 9 of the bag with the inner end of this section (the inner end of the tab) adjacent the fold line as appears in FIG. 9, a section 77 between portions 71 and 73 of the walls 7 and 9, a section 79 underneath the extension 11, and an outer end section 81 projecting out from under the extension 11. Portion 71 of wall 7 and the extension 11 are adhered by adhesive at 69 to the outside face of wall 7. Section 79 of the tab underneath the extension 11 is adhered by adhesive at 69 to the outside face of wall 7. The outer end section 81 of the tab is generally left wholly free of the wall 7 to enable it to be grasped and pulled to tear the bag open as shown in FIG. 11, but it will be understood that it might be adhered in part (e.g., spot-adhered) to wall 7 to lock it in place until it is used. In any event, the outer end section 81 of the tab is free at least in part of wall 7 to enable it to be grasped and pulled.

Figure 12:
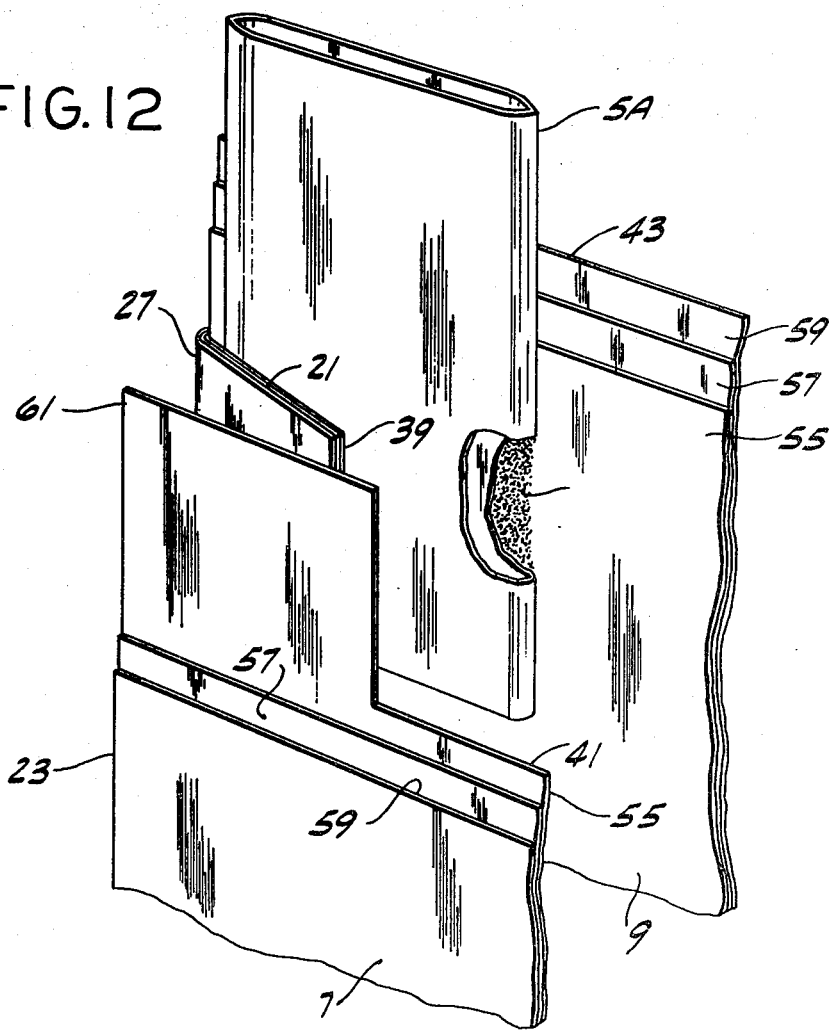
FIG. 12 is a view similar to FIG. 6 showing the tab made as a flat tubular member or sleeve to function as a valve.

Generally, the bag is supplied by the bag manufacturer to the bag packer with the pinch closure 67 at end 1 of the bag and constituting a pinch bottom for the bag, with the tab 5 incorporated in the pinch closure or pinch bottom 67, and with the bag open at its other end 3 for filling, i.e., the bag is a pinch bottom open mouth ("PBOM") bag. After the bag is filled, it is closed by means of a pinch closure in conventional manner at its mouth end 3. To open the bag, the tab 5 is grasped and pulled in the direction away from the bag (up as viewed in FIGS. 8, 9 and 11), resulting in tearing of the closure or flap 67 at 83 and thereby providing an opening for pouring out the bag contents at the tab corner. The extension or tongue 61 covers the ends 19 and 21 of the gusset 15 and acts as a barrier to their adherence to the outside face of the front wall 7 of the bag, and this makes it easier to pull the tab to open the bag. If the gusset ends 19 and 21 were uncovered and adhered to the wall 7 (by the hot melt adhesive used to adhere the flap 67 to wall 7) it might make it too difficult to pull the tab. Weakness that may result from not adhering the gusset ends 19 and 21 to wall 7 tends to be offset by having the tab in the pinch closure. Broadly considered, the tab may be located at various points along the pinch closure 67. It is contemplated that the tab may bear information and thereby serve the dual purpose of providing an informational feature and an easy-open feature. It is also contemplated that the tab may be made as a flat tubular member as indicated at 5A in FIG. 12 open at its outer end outside the bag and at its inner end between the bag walls to serve as a valve sleeve for filling the bag. In this case, the bag is supplied closed at both ends by the manufacturer. It is further contemplated that the tab as inserted in the bag tube may be folded to conform to one or both halves of the gusset to act as a pouring spout when the bag is opened.

While the tab is generally incorporated in the bag by the bag manufacturer, it is conceivable that it may be supplied by the manufacturer to the bag packer closed at end 3 and open at end 1 without the tab, the tab being applied after the bag has been filled and the bag closed at end 1, and further conceivable that it may be supplied by the manufacturer to the bag packer closed at end 3 and open at 1 with the tab applied at end 1.

Figure 13:
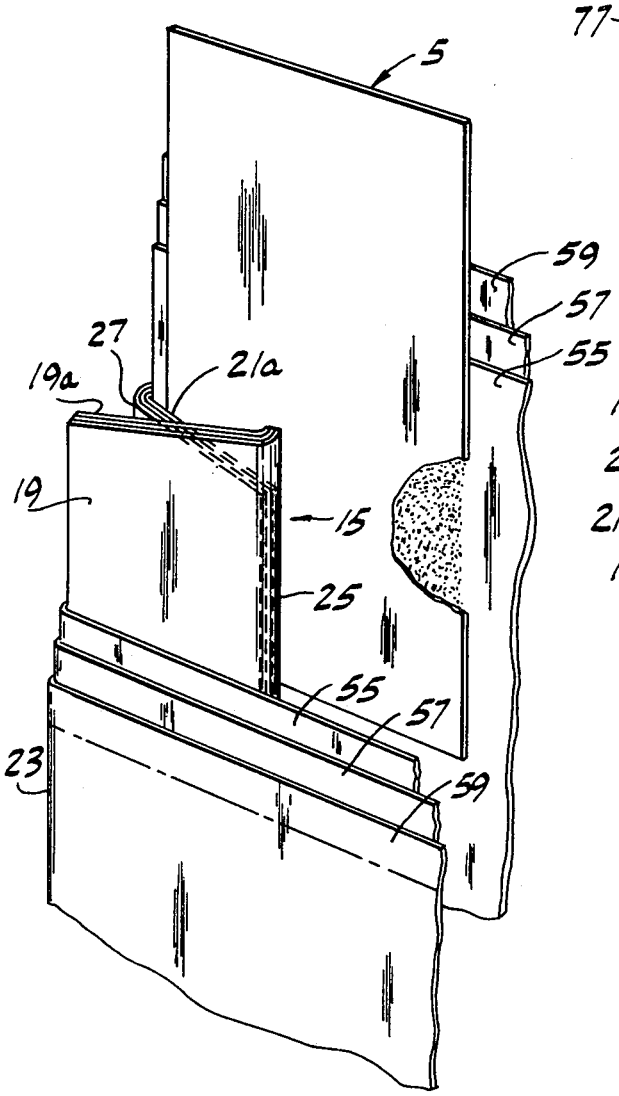
FIG. 13 is a view similar to FIG. 6, showing only the upper left corner, of a modification.
Figure 14:
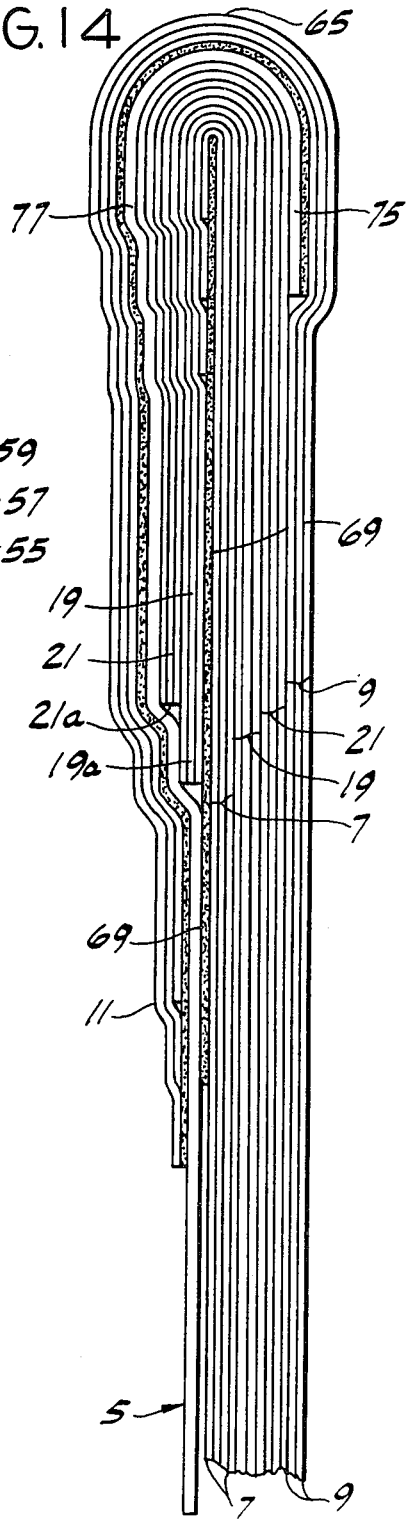
FIG. 14 is a view similar to FIG. 9 showing the FIG. 13 modification.

FIGS. 13 and 14 illustrate a modification in which at the tab corner of the bag (the upper left corner) the first (front) and second (back) halves of the gusset 15 are reversely stepped, i.e., the first (front) half 19 of the gusset is stepped up above the second (back) half 21, instead of the second (back) half being stepped up above the first (front) half. In FIG. 13, the stepped-up portion of the first (front) half 19 is indicated at **19*a*. It will be noted that this extends up above the upper edge 21*a* of the second (back) half. As will be readily understood, at the lower left corner, this relationship is the opposite, that is the second (back) half of the gusset extends down below the first (front) half. Here again, the tab 5 is inserted between the second (back) half 21 of the left-hand gusset and the back wall 9 (including extension 11) of the bag tube, and the closure formed by folding the flap 67 over on the fold line 65 and adhering it to the front wall 7 as shown in FIG. 14. The first (front) half 19 of the gusset is adhered to the front wall 7. However, the second (back) half 21 of the gusset, being wholly under the first (front) half, is free of the front wall. The first half 19 acts as a barrier to adherence of the second half 21 to the front wall. With the first half 19** adhered to the front wall, the bag is somewhat stronger than the first embodiment, but it may not form as good a pour spout.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A bag having a pinch closure at one end and a tab for opening it at said end, the bag being formed from a bag tube having first and second walls flat against one another, the second wall having an extension beyond the first at said end, the closure comprising a flap constituted by an end portion of the bag tube at said end folded over on a fold line spaced inwardly from the end edge of the first wall at said end, said flap thereby comprising the end portion of the first wall from the fold line to said end edge of the first wall and a portion of the second wall coextensive with said end portion of the first wall and said extension of the second wall, the tab having a section between said portions of the walls with an inner end adjacent the fold, a section underneath said extension, and an outer end section projecting out from under said extension, said flap being adhered to the outside face of the first wall and the outside face of the tab to seal the closure under the flap, the section of the tab underneath the extension being adhered to the outside face of the first wall to seal the closure under the tab, and the outer end section of the tab being free at least in part of the first wall to enable said outer end section of the tab to be grasped and pulled to tear the bag open by tearing away from the first wall of the portion of the flap adhered to the tab.

2. A bag set forth in claim 1 wherein the tab is adjacent one side of the bag at said end.

3. A bag set forth in claim 2 having gussets at its sides, said gussets having end portions extending beyond the end of said first wall at said one end of the bag and terminating short of the said extension of said second wall at said one end of the bag, each gusset having a first half toward the first wall and a second half toward the second wall, said tab lying between the second half of the gusset at that side of the bag and said second wall of the bag, said first wall of the bag having a tongue at said one side and said one end of the bag generally completely covering the said end portions of the gusset at that side of the bag.

4. A bag as set forth in claim 3 having a plurality of plies, said tongue being constituted by an extension of one ply only of said first wall.

5. A bag as set forth in claim 3 wherein said end portions of the gussets are stepped, with the second half of the gusset at said one side of the bag and said one end of the bag stepped beyond the end of the first half of that gusset, said tongue extending over the portion of the second half of said gusset which is stepped beyond the end of the first half of said gusset.

6. A bag as set forth in claim 5 having a plurality of plies, said tongue being constituted by an extension of the inner ply only of said first wall.

7. A bag as set forth in claim 1 wherein said tab extends inwardly past said fold line and is itself folded on said fold line along with said flap.

8. A bag as set forth in claim 7 wherein the tab is adjacent one side of the bag at said end.

9. A bag as set forth in either of claims 2 or 8 having gussets at its sides, said gussets having end portions extending beyond the end of said first wall at said one end of the bag and terminating short of the said extension of said second wall at said one end of the bag, each gusset having a first half toward the first wall and a second half toward the second wall, said tab lying between the second half of the gusset at that side of the bag and said second wall of the bag, the first half of the gusset being stepped beyond the second half of the gusset at said one side of the bag.

10. A bag as set forth in claim 8 having gussets at its sides, said gussets having end portions extending beyond the end of said first wall at said one end of the bag and terminating short of the said extension of said second wall at said one end of the bag, each gusset having a first half toward the first wall and a second half toward the second wall, said tab lying between the second half of the gusset at that side of the bag and said second wall of the bag, said first wall of the bag having a tongue at said one side and said one end of the bag generally completely covering the said end portions of the gusset at that side of the bag.

11. A bag as set forth in claim 10 having a plurality of plies, said tongue being constituted by an extension of one ply only of said first wall.

12. A bag as set forth in claim 10 wherein said end portions of the gussets are stepped, with the second half of the gusset at said one side of the bag and said one end of the bag stepped beyond the end of the first half of that gusset, said tongue extending over the portion of the second half of said gusset which is stepped beyond the end of the first half of said gusset.

13. A bag as set forth in claim 12 having a plurality of plies, said tongue being constituted by an extension of the inner ply only of said first wall.

14. A bag as set forth in any one of claims 1, 4 or 11 wherein the tab is tubular and serves as a valve sleeve.

15. The method of making a bag with a pinch closure and means for opening the bag at the closure comprising providing a bag tube having first and second walls flat against one another with an extension of the second wall beyond the first wall at one end of the tube, opening up the tube at said one end, inserting a tab into the tube with the tab at its inner end between the walls and at its outer end extending out beyond the end edge of the extension of said one end and adhering the tab to said second wall, forming a pinch closure for the bag tube at said one end by folding over a flap constituted by an end portion of the tube at said one end on a fold line extending transversely of the bag tube spaced inwardly from the respective end edge of said first wall and adjacent the inner end of the tab, the tab being folded over with the flap, and adhering the flap to the outside face of the first wall and the outside face of the tab to seal the closure under the flap, and adhering the section of the tab underneath the extension to said first wall to seal the closure under the tab, leaving the outer end section of the tab which extends out beyond the end edge of the extension free at least in part of said first wall to be grasped and pulled to tear the bag open by tearing away from the first wall of the portion of the flap adhered to the tab.

16. The method of claim 15 wherein the tab is inserted adjacent one side of the bag of said one end.

17. The method of claim 16 wherein the bag tube is provided with gussets at its sides having end portions extending beyond the end of said first wall at said one end of the bag and terminating short of the said extension of said second wall at said one end of the bag, each gusset having a first half toward the first wall and a second half toward the second wall, the first wall of the bag having a tongue at said one side and said one end of the bag generally completely covering the said end portions of the gusset at that side of the bag, the tab being inserted between the second half of the gusset at that side of the bag and said second wall of the bag, the tongue being folded over on folding said flap and acting as a barrier to adherence of the said end portions of said gusset to said first wall.

18. The method of claim 17 wherein the tab is inserted past the fold line.

19. The method of claim 16 wherein the bag tube is provided with gussets at its sides having end portions extending beyond the end of said first wall at said one end of the bag and terminating short of the said extension of said second wall at said one end of the bag, each gusset having a first half toward the first wall and a second half toward the second wall, the first half of the gusset being stepped beyond the second half of the gusset at said one side of the bag, the tab being inserted between the second half of the gusset at that side of the bag and said second wall of the bag, the first half of the gusset being adhered to the first wall of the bag, the second half of the gusset, being wholly under the first half, being free of said first wall.

20. The method of claim 19 wherein the tab is inserted past the fold line.

* * * * *